United States Patent [19]

James

[11] 4,106,202

[45] Aug. 15, 1978

[54] APPARATUS FOR INDICATING THE ANGLE OF A DRAFTING PARALLEL

[76] Inventor: Joseph W. James, 501 W. Whiting, Fullerton, Calif. 92632

[21] Appl. No.: 849,680

[22] Filed: Nov. 8, 1977

[51] Int. Cl.[2] ..... B43L 13/02

[52] U.S. Cl. ..... 33/80

[58] Field of Search ..... 33/79, 76, 80, 81

[56] References Cited

U.S. PATENT DOCUMENTS

| | | | |
|---|---|---|---|
| 1,482,606 | 2/1924 | Goldrick | 33/80 |
| 2,627,323 | 2/1953 | Larson | 33/76 X |

*Primary Examiner*—Harry N. Haroian

*Attorney, Agent, or Firm*—Philip M. Hinderstein

[57] ABSTRACT

Apparatus for use with a drafting board and a drafting parallel of the type including a straight edge suspended by cables on one surface of the board for parallel movement therealong, comprising means for releasably locking one end of the straight edge in a fixed position relative to the drafting board so as to permit pivotable movement only of the straight edge, an angle scale connected to the board adjacent the other end of the straight edge for indicating the amount of pivotable movement of the straight edge, and a pointer connected to the other end of the straight edge for use in association with the angle scale.

7 Claims, 7 Drawing Figures

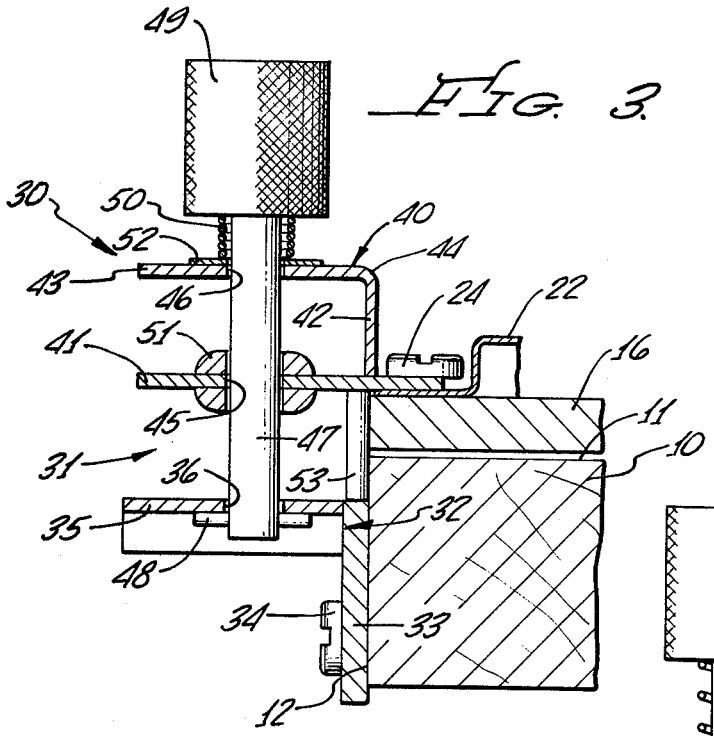
FIG. 3.
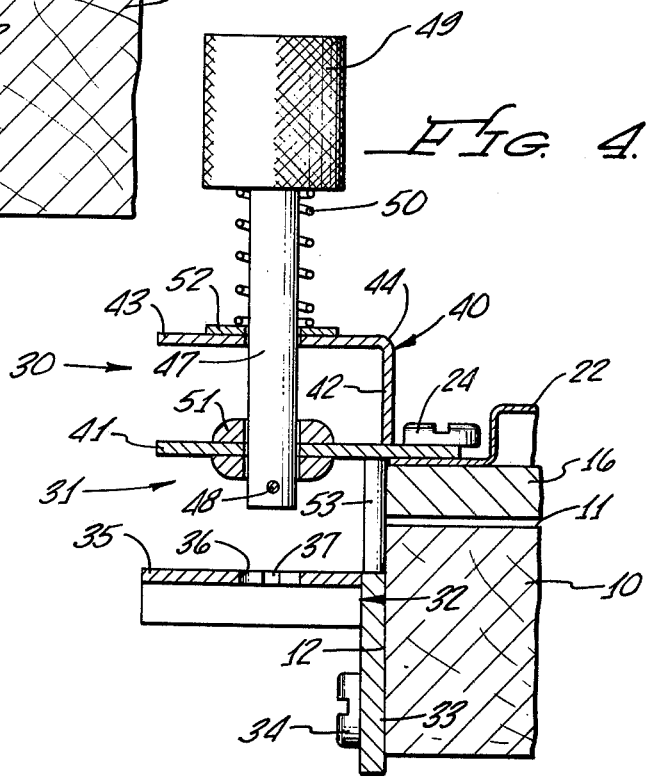
FIG. 4.
FIG. 5.
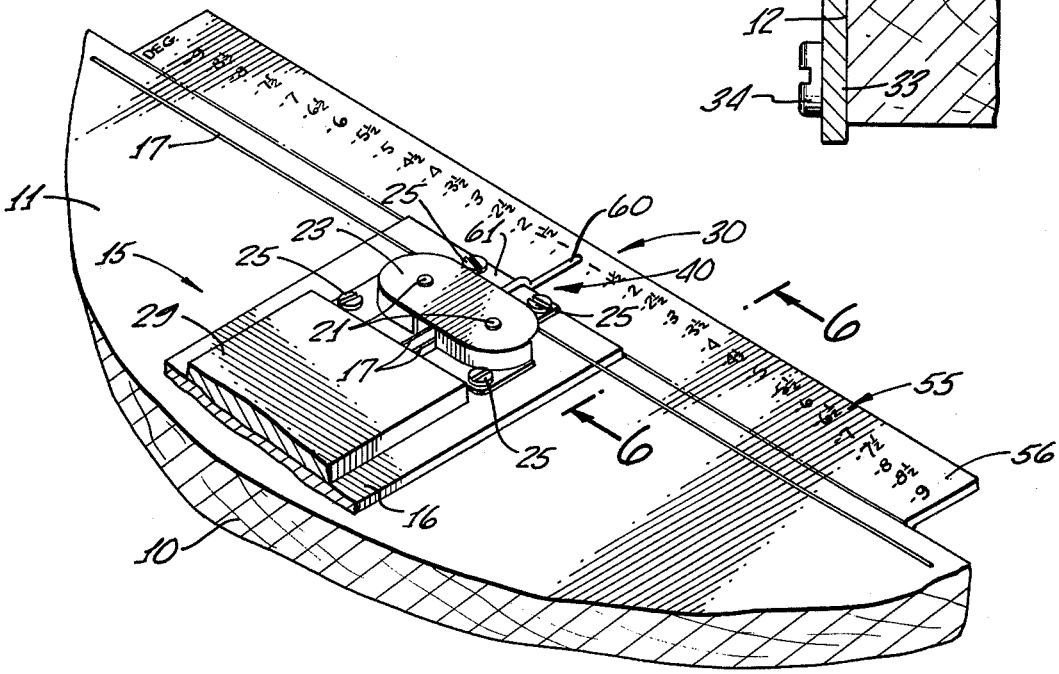

APPARATUS FOR INDICATING THE ANGLE OF A DRAFTING PARALLEL

BACKGROUND OF THE INVENTION

1. Field of the Invention

The present invention relates to apparatus for indicating the angle of a drafting parallel and, more particularly, to apparatus for use with a drafting board and a drafting parallel of the type including a straight edge suspended by cables on one surface of the board for parallel movement therealong for setting and indicating the angle of the straight edge.

2. Description of the Prior Art

In the field of drafting, there are three major types of apparatus for drawing parallel lines on a drafting board. The first type consists of a simple T-square. The second type consists of a drafting machine including a series of arms and linkages fixedly connected to the drafting board, at one end thereof, and movable over the face of the board. The third type is referred to as a drafting parallel and includes a straight edge suspended by cables on one surface of the drafting board for parallel movement therealong.

The most popular of the three types is the drafting parallel since it has several advantages. One is that it can be made with a length to extend across the entire width of the drafting board. Secondly, the angle of the straight edge may be adjusted over a wide range and this angle will remain fixed as the straight edge moves along the surface of the drafting board.

However, a problem has existed in setting the angle of the straight edge. The most commonly used technique is to use an adjustable triangle, lining one edge of the triangle up with a known reference line on the drafting board and then moving the straight edge until it is parallel to another edge of the triangle. While this appears satisfactory, it is not, for at least two reasons. First of all, existing adjustable triangles are somewhat confusing and until one becomes very familiar therewith, it is often difficult to remember which sides of the triangle are used for setting the angle of the straight edge. Secondly, the scales on typical adjustable triangles are very small and it is difficult to accurately set angles within $\frac{1}{2}°$.

SUMMARY OF THE INVENTION

According to the present invention, there is provided apparatus for accurately setting and indicating the angle of the straight edge of a drafting parallel. The present apparatus can be readily adapted to present board parallels and can be sold as a kit for attachment thereto. With the present apparatus, the straight edge of a drafting parallel can be instantaneously positioned at any desired angle and accurately set to an accuracy of $\frac{1}{2}°$ or less. The present apparatus completely eliminates the need for adjustable triangles. The present apparatus can be readily adapted to any of the different standard lengths of drafting parallels.

Briefly, the present apparatus for use with a drafting board and a drafting parallel of the type including a straight edge suspended by cables on one surface of the board for parallel movement therealong comprises means for releasably locking one end of the straight edge in a fixed position relative to the drafting board so as to permit pivotable movement only of the straight edge, an angle scale connected to the board adjacent the other end of the straight edge for indicating the amount of pivotable movement of the straight edge, and a pointer connected to the other end of the straight edge for use in association with the angle scale.

It is therefore an object of the present invention to provide apparatus for setting and indicating the angle of a drafting parallel.

It is a further object of the present invention to provide apparatus for use with a drafting board and a drafting parallel of the type including a straight edge suspended by cables on one surface of the board for parallel movement therealong for indicating the angle thereof.

It is a still further object of the present invention to provide apparatus for indicating the angle of a drafting parallel which is readily adapted to present drafting parallels.

It is another object of the present invention to provide apparatus for indicating the angle of a drafting parallel to an accuracy of $\frac{1}{2}°$ or less.

It is another object of the present invention to provide apparatus for indicating the angle of a drafting parallel in which the angle can be set within a matter of seconds.

It is still another object of the present invention to provide apparatus for indicating the angle of drafting parallel which eliminates the use of adjustable triangles.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIGS. 3 and 4 are sectional views taken along the line 3—3 in FIG. 2;

FIG. 5 is an enlarged perspective view of the present apparatus connected to the other end of the straight edge of the drafting parallel of FIG. 1;

DESCRIPTION OF THE PREFERRED EMBODIMENT

Figure 1:
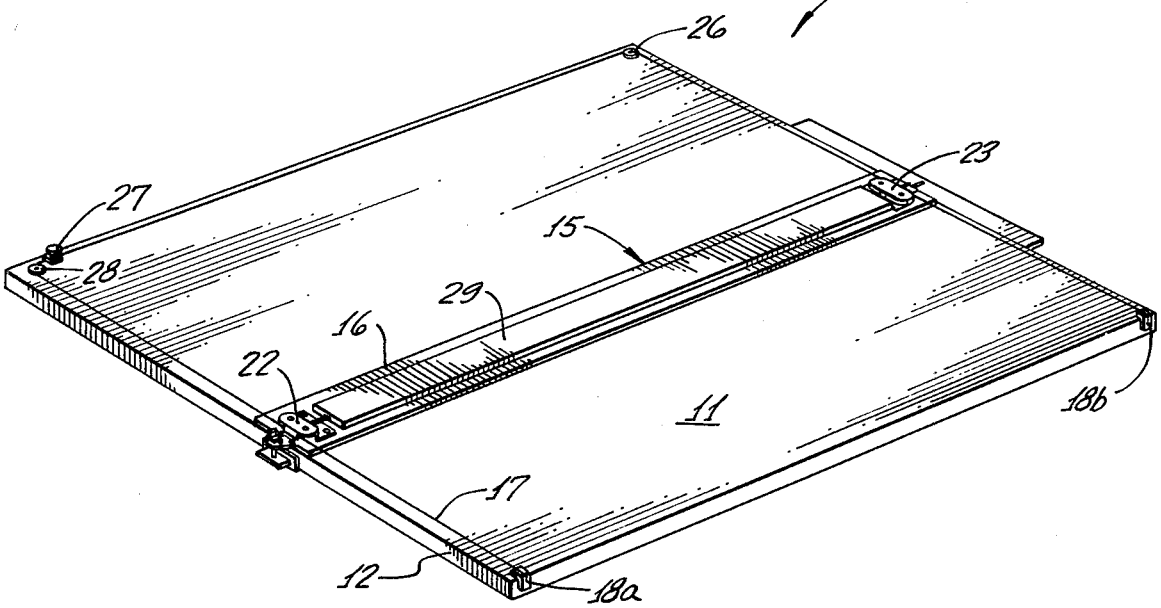
FIG. 1 is a perspective view of a drafting board and a drafting parallel and the present apparatus for setting and indicating the angle of the drafting parallel.

Referring now to the drawings, the present apparatus is designed for use with a drafting board 10 including a front work surface 11 and opposed side edges 12 and 13. Mounted on drafting board 10 is a drafting parallel, generally designated 15. Drafting parallel 15 includes an elongate, generally rectangular straight edge 16 which extends along surface 11, parallel thereto, between side edges 12 and 13.

As is well known to those skilled in the art, straight edge 16 is supported for parallel movement along surface 11 of drafting board 10 by a continuous cable 17, the opposite ends of which are secured by brackets **18*a* and 18*b* along the lower edge of drafting board 10. More specifically, drafting parallel 15 includes a pair of rollers 19 mounted on a pair of parallel, spaced pins 20 adjacent one end 5 of straight edge 16 and a similar pair of rollers 14 mounted on a pair of parallel, spaced pins 21 adjacent the other end 6 of straight edge 16. The pairs of rollers are supported within housings 22 and 23, respectively, which are secured to straight edge 16 by screws 24 and 25**, respectively.

In the operation of drafting parallel 15, cable 17 extends from bracket 18*a* around the lower roller 19, across the top surface of straight edge 16, around the upper roller 14, around a roller 26 mounted on surface 11 of drafting board 10, adjacent the upper right hand corner thereof, past a cable locking bracket 27, around another roller 28 mounted on surface 11 of drafting board 10, adjacent the upper left hand corner thereof, around the upper roller 19, across the top surface of straight edge 16, around the lower roller 14, and finally to bracket 18*b*. A cover 29 extends along the upper surface of straight edge 16 to protect the two lengths of cable extending therealong.

As is known in the art, the above arrangement of cable 17 permits straight edge 16 to move along surface 11 of drafting board 10, between brackets 18*a* and 18*b* and rollers 26 and 28, while both the upper and lower edges remain parallel. This is guaranteed by locking bracket 27 which secures cable 17 to drafting board 10 and prevents linear movement thereof. On the other hand, by releasing locking bracket 27 and gripping the opposite ends of straight edge 16, straight edge 16 may be rotated to change the angle of the upper and lower edge thereof relative to the side edges of board 10. As this is done, the portion of cable 17 between straight edge 16 and rollers 26 and 28 moves linearly. Once the desired position of straight edge 16 is determined, bracket 27 is tightened so that movement of straight edge 16 now continues in a parallel, but offset direction.

According to the present invention, there is provided apparatus, generally designated 30, for setting and indicating the angle of straight edge 16 of drafting parallel 15 relative to drafting board 10. Apparatus 30 includes means, generally designated 31, for releasably locking end 5 of straight edge 16 in a fixed position relative to side edge 12 of drafting board 10 so as to permit pivotal movement only of straight edge 16. More specifically, locking means 31 includes a first bracket 32 secured to side edge 12 of drafting board 10. Bracket 32 has a generally L-shaped configuration including a first side 33 connectable to side edge 12 of drafting board 10 such as by means of screws 34. Bracket 32 includes a second side 35 which extends perpendicular to side 34, generally parallel to surface 11 of drafting board 10. Side 35 of bracket 32 has a central hole 36 therein and a pair of opposed keyways 37 which communicate with hole 36.

Locking means 31 further includes a second bracket 40 which is connectable to end 5 of straight edge 16 so that bracket 40 passes above bracket 32 during movement of straight edge 16. More specifically, bracket 40 includes a support plate 41 which may be secured to straight edge 16 by the same screws 24 utilized to connect housing 22 to straight edge 16. In any event, support plate 41 extends to the side of straight edge 16, parallel thereto and parallel to side 35 of bracket 32. Connected to plate 41 is one edge of one side 42 of an L-shaped plate 44, the other side 43 of which extends parallel to and above plate 41.

Figure 2:
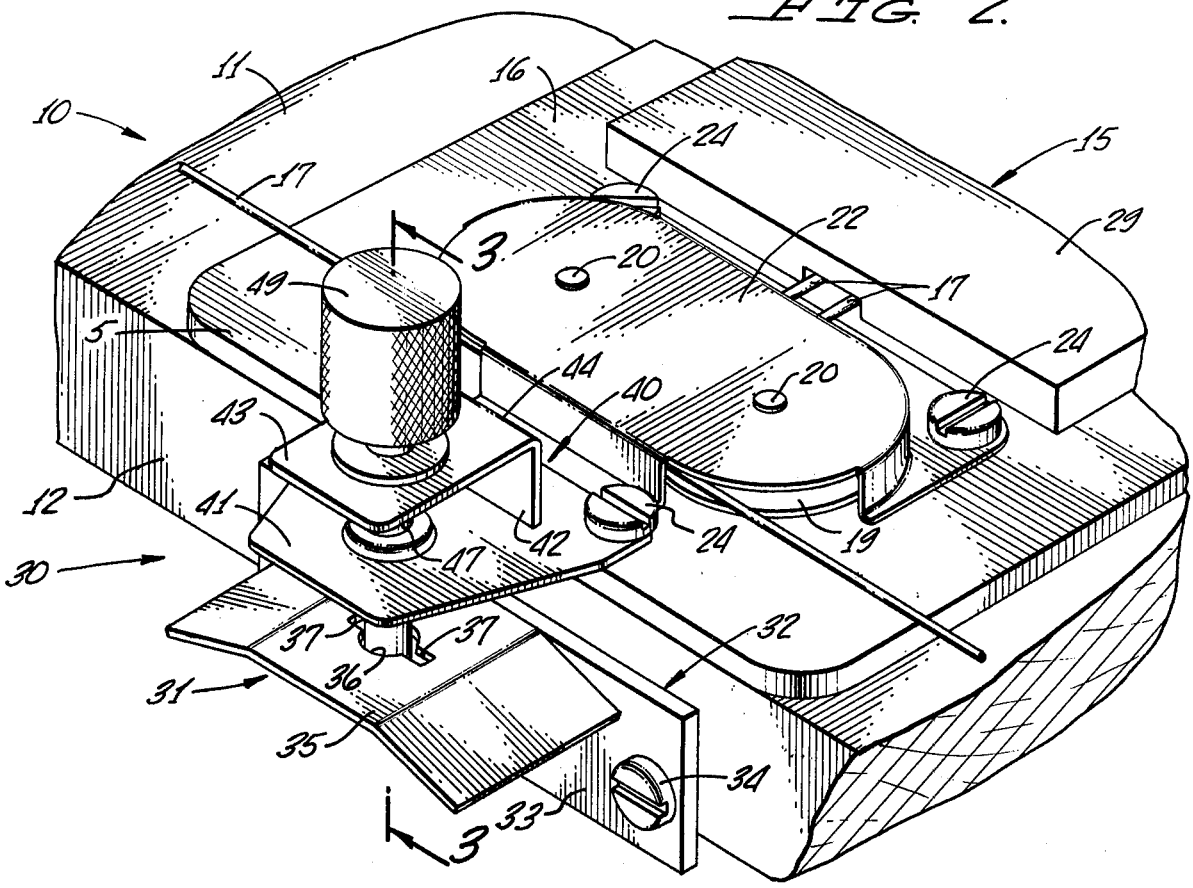
FIG. 2 is an enlarged perspective view of the present apparatus connected to one end of the straight edge of the drafting parallel of FIG. 1.
Figure 6:
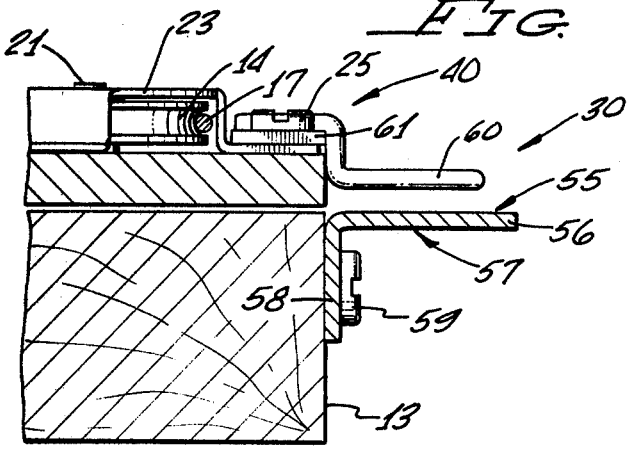
FIG. 6 is a sectional view taken along the line 6—6 of FIG. 5.

Plate 41 and side 43 of plate 44 have aligned holes 45 and 46, respectively, therein, through which extend a shaft 47. As will be seen from an examination of FIGS. 2–4, shaft 47 may be aligned coaxially with hole 36 in side 35 of bracket 32 in one position of straight edge 16. Therefore, the diameter of shaft 47 is slightly less than the diameter of hole 36. Connected to the lower end of shaft 47 is a laterally extending pin 48, the length of which is slightly less than the combined length of keyways 37 and the diameter of hole 36. Thus, in the position of shaft 47 shown in FIG. 4, shaft 47 may be extended through hole 36 and pin 48 passes through keyways 37. Upon rotation of shaft 47 to the position shown in FIG. 3, pin 48 is trapped below side 35 of bracket 32.

Connected to the upper end of shaft 47 is knob 49 for use in manipulating shaft 47. Positioned between side 43 of plate 44 and knob 49 is a spring 50 which urges shaft 47 upwardly.

Completing the description of locking means 31, plate 41 has a collar 51 secured thereto to assist in supporting and guiding shaft 47. A collar 52 is also connected to the upper surface of side 43 of plate 44 to function as a support pad for the lower end of spring 50. A pin 53 has one end thereof connected to the lower end of plate 41 and extends downwardly therefrom, perpendicular to surface 11 of drafting board 10. Pin 53 is adapted to ride along side edge 12 of drafting board 10 to prevent axial movement of straight edge 16 and to help in the alignment of shaft 47 with hole 36.

In operation, it is evident that in the position shown in FIG. 4, shaft 47 is held out of engagement with bracket 32 and the operation of drafting parallel 15 is as usual. On the other hand, straight edge 16 may be moved to align shaft 47 with hole 36 and knob 49 may be used to depress shaft 47, compressing spring 50 until shaft 47 enters hole 36. Knob 49 is then used to rotate shaft 47 until pin 48 is aligned with keyways 37. Continued depression of shaft 47 causes in 48 to pass through keyways 37 to a position below side 35 of bracket 32. An additional rotation of shaft 47 by knob 49 prevents the removal of shaft 47 from hole 36. Accordingly, means 31 does indeed releasably lock end 5 of straight edge 16 in a fixed position relative to drafting board 10. At this time, however, end 6 of straight edge 16 is free to move, which it will do upon releasing locking bracket 27. Accordingly, straight edge 16 may be pivoted around the fixed pivot point defined by the axis of hole 36.

Apparatus 30 also includes an angle scale 55 connectable to side edge 13 of drafting board 10 for indicating the amount of angular rotation of straight edge 16 when locking means 31 is engaged. Specifically, angle scale 55 is mounted on one side 56 of an L-shaped bracket 57, the other side 58 of which is connectable to side edge 13 of drafting board 10, such as by means of screws 59. Side 56 is arranged parallel to surface 11 of drafting board 10 and the upper surface thereof is approximately coplanar therewith. Angle scale 55 is spaced along side 56 in a generally arcuate configuration.

Apparatus 10 includes a pointer 60, one end of which is connected to a bracket 61 which is connectable to end 6 of straight edge 16. Bracket 61 may be most conveniently connected to straight edge 16 by means of the same screws 25 utilized to connect housing 23 to straight edge 16. In any event, pointer 60 is coaxial with the longitudinal axis of straight edge 16, pointer 60 extending beyond side edge 13 of drafting board 10, above angle scale 55.

Figure 7:
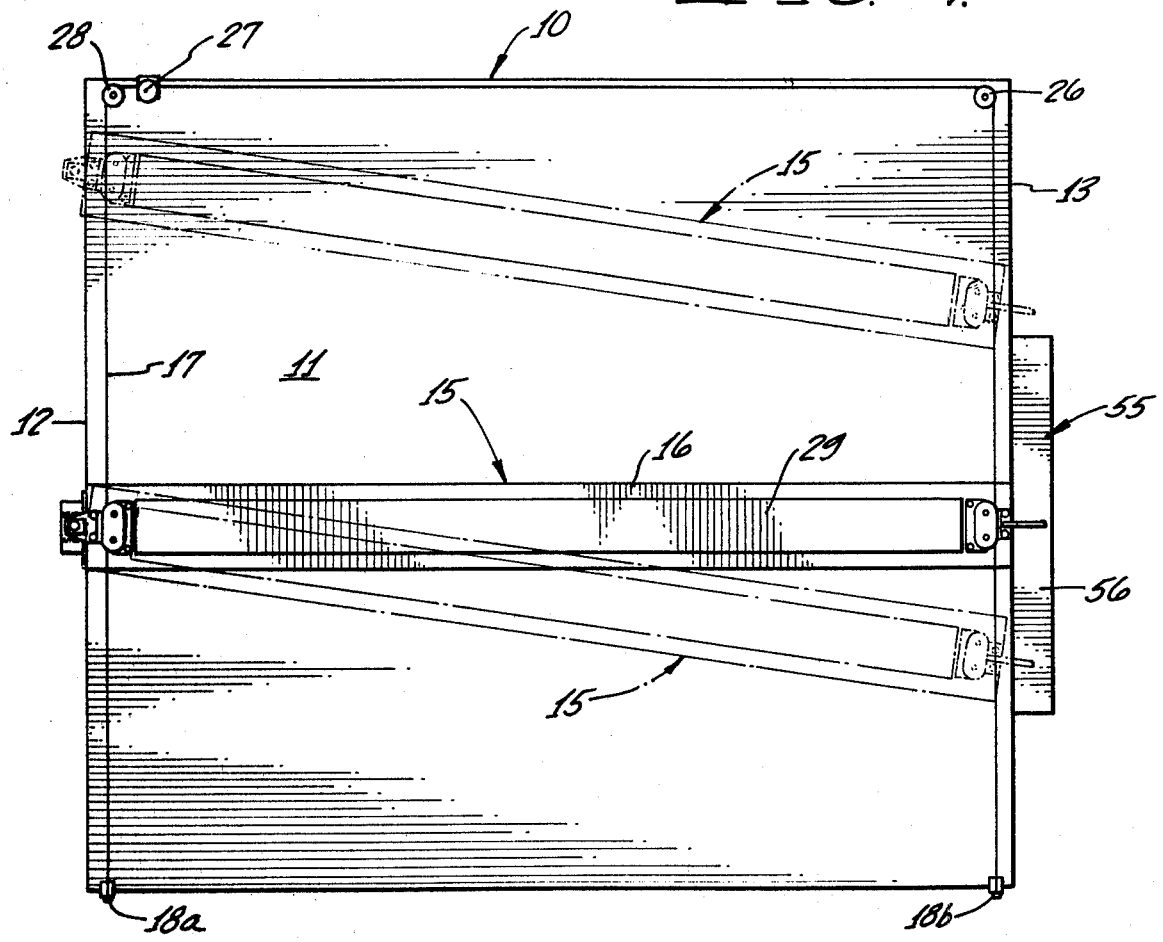
FIG. 7 is a plan view of the drafting board and drafting parallel of FIG. 1 showing the operation of the present invention.

The operation of apparatus 30 may be best understood with reference to FIG. 7. Under normal circumstances, straight edge 16 is freely movable along surface 11 of drafting board 10. In the position where shaft 47 is coaxial with hole 36 in side 35 of bracket 32, pointer 60 is aligned with the 0° mark on angle scale 55 when straight edge 16 is perpendicular to side edges 12 and 13 of drafting board 10. To change the angle of straight edge 16, locking means 31 is engaged, as described previously, to prevent movement of end 5 of straight edge 16. This position is shown in solid lines in FIG. 7. At this time, with locking bracket 27 releasing cable 17, end 6 of straight edge 16 may be pivoted, with pointer 60 moving along angle scale 55. Because of the length of straight edge 16, the spacing between the markings on angle scale 55 are very large and it is relatively simple to accurately adjust the angle of straight edge 16 to ½° or less. In any event, when the desired angular orientation of straight edge 16 is achieved, locking bracket 27 is tightened to prevent linear movement of cable 17, preventing any further rotation of straight edge 16. This position is shown in phantom in FIG. 7.

At this time, knob 49 can be rotated to align pin 48 with keyways 37, whereupon spring 50 returns shaft 47 to the position shown in FIG. 4. Thereafter, straight edge 16 may move freely along surface 11 of drafting board 10, maintaining the angle previously set. A typical position is also shown in phantom in FIG. 7.

It is evident that the spacing between the numbers on angle scale 55 will be a function of the length of straight edge 16 and the spacing between bracket 57 and locking means 31. Therefore, while locking means 31 remains the same, a different angle scale 55 will be provided for drafting parallels of different sizes.

It can therefore be seen that according to the present invention, there is provided apparatus 30 for accurately setting and indicating the angle of the straight edge 16 of a drafting parallel 15. Apparatus 30 can be readily adapted to present board parallels and can be sold as a kit for attachment thereto. With apparatus 30, straight edge 16 of drafting parallel 15 can be instantaneously positioned at any desired angle and accurately set to an accuracy of ½° or less. Apparatus 30 completely eliminates the need for adjustable triangles and apparatus 30 can be readily adapted to any different standard lengths of drafting parallels.

While the invention has been described with respect to a preferred physical embodiment constructed in accordance therewith, it will be apparent to those skilled in the art that various modifications and improvement may be made without departing from the scope and spirit of the invention. For example, angle scale 55 need not be connected to board 10 in the manner shown. Angle scale 55 could be applied directly to surface 11 of board 10, such as with a decal. Accordingly, it is to be understood that the invention is not to be limited by the specific illustrative embodiment, but only by the scope of the appended claims.

I claim:

1. Apparatus for use with a drafting board and a drafting parallel of the type including a straight edge suspended by cables on one surface of said board for parallel movement therealong, comprising:

means for releasably locking one end of said straight edge in a fixed position relative to said drafting board so as to permit pivotable movement only of said straight edge; and an angle scale connectable to said board adjacent the other end of said straight edge for indicating the amount of angular rotation of said straight edge.

2. Apparatus according to claim 1, further comprising:

pointer means connected to said other end of said straight edge for use in association with said scale.

3. Apparatus according to claim 1, wherein said locking means comprises:

first means secured to one side edge of said drafting board; and second means secured to said one end of said straight edge, said first and second means being releasably interconnectable.

4. Apparatus according to claim 3, wherein said first means is secured to said drafting board at a central point along said side edge thereof.

5. Apparatus according to claim 3, wherein said first means comprises:

an L-shaped bracket, one side of which is connected to said one side edge of said drafting board, the other side of which has a hole and a keyway therein.

6. Apparatus according to claim 5, wherein said second means comprises:

an elongate shaft; and means for supporting said shaft for axial movement in a direction perpendicular to said one surface of said board, said shaft having a pin at one end thereof, said shaft being positionable in axial alignment with said hole in said bracket in one position of said straight edge relative to said drafting board, said shaft and said pin being extendable through said hole and said keyway to permit a releasable interconnection between said shaft and said bracket.

7. Apparatus according to claim 6, wherein said second means further comprises:

a knob connected to the other end of said shaft for use in manipulating said shaft; and a spring connected between said knob and said supporting means for biasing said one end of said shaft out of contact with said bracket.

* * * * *